US010450872B2

(12) United States Patent
Koenig et al.

(10) Patent No.: US 10,450,872 B2
(45) Date of Patent: Oct. 22, 2019

(54) UNDERCUT ON AIRFOIL COVERSHEET SUPPORT MEMBER

(71) Applicant: Rolls-Royce Corporation, Indianapolis, IN (US)

(72) Inventors: Eric Koenig, Fishers, IN (US); Charles A. Bulgrin, Plainfield, IN (US); Mike Engle, Martinsville, IN (US); Jeffrey F. Rhodes, Zionsville, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 255 days.

(21) Appl. No.: 15/346,419

(22) Filed: Nov. 8, 2016

(65) Prior Publication Data

US 2018/0128111 A1 May 10, 2018

(51) Int. Cl.

| | |
|---|---|
| ***F01D 5/14*** | (2006.01) |
| ***F01D 5/18*** | (2006.01) |
| ***F01D 9/04*** | (2006.01) |
| ***F01D 25/12*** | (2006.01) |

(52) U.S. Cl.

CPC ..... *F01D 5/147* (2013.01); *F01D 5/18* (2013.01); *F01D 5/187* (2013.01); *F01D 9/041* (2013.01); *F01D 25/12* (2013.01); *F05D 2220/32* (2013.01); *F05D 2230/232* (2013.01); *F05D 2240/121* (2013.01); *F05D 2240/124* (2013.01); *F05D 2240/303* (2013.01);

(Continued)

(58) Field of Classification Search

CPC . F01D 5/147; F01D 5/18; F01D 25/12; F01D 5/187; F05D 2260/941; F05D 224/303; B64C 3/26

See application file for complete search history.

(56) References Cited

U.S. PATENT DOCUMENTS

| | | | | |
|---|---|---|---|---|
| 3,574,481 | A * | 4/1971 | Pyne, Jr. ..... | F01D 5/189 416/90 R |
| RE34,207 | E | 3/1993 | Nelson et al. | |
| 6,213,714 | B1 | 4/2001 | Rhodes | |

(Continued)

FOREIGN PATENT DOCUMENTS

| | | |
|---|---|---|
| EP | 1 898 055 A2 | 3/2008 |

OTHER PUBLICATIONS

Extended European Search Report, pp. 1-8, dated Mar. 12, 2018, issued in European Patent Application No. 17195394.6, European Patent Office, Munich, Germany.

(Continued)

*Primary Examiner* — Dwayne J White
*Assistant Examiner* — Wesley Le Fisher
(74) *Attorney, Agent, or Firm* — Brinks Gilson & Lione

(57) ABSTRACT

Methods of providing an undercut on a support member for a coversheet and coversheet support systems having undercuts are provided. A coversheet support system may include a spar. The spar may include a support member on an outer surface of the spar. The support member may extend outward from the outer surface of the spar. The support member may include an outer surface and an undercut. The undercut may be located in a portion of the support member between the outer surface of the spar and the outer surface of the support member. In addition, the coversheet support system may include a coversheet. The coversheet may be metallurgically bonded to the outer surface of the support member.

17 Claims, 2 Drawing Sheets

(52) U.S. Cl.
CPC .... *F05D 2240/306* (2013.01); *F05D 2260/20* (2013.01); *F05D 2260/941* (2013.01)

(56) References Cited

U.S. PATENT DOCUMENTS

| | | | | |
|---|---|---|---|---|
| 6,238,182 | B1 * | 5/2001 | Mayer | F01D 5/189 415/115 |
| 6,390,775 | B1 | 5/2002 | Paz | |
| 6,418,618 | B1 | 7/2002 | Burdgick | |
| 6,769,877 | B2 | 8/2004 | Martin et al. | |
| 8,162,617 | B1 * | 4/2012 | Davies | F01D 5/147 416/223 R |
| 8,167,537 | B1 * | 5/2012 | Plank | F01D 5/147 415/115 |
| 8,287,241 | B2 | 10/2012 | Strohl et al. | |
| 8,292,583 | B2 * | 10/2012 | Marra | F01D 5/147 415/115 |
| 9,556,750 | B2 * | 1/2017 | Freeman | F01D 5/147 |
| 9,999,948 | B2 * | 6/2018 | Stampfli | B23P 6/005 |
| 2004/0213672 | A1 | 10/2004 | Gautreau et al. | |
| 2008/0056904 | A1 * | 3/2008 | Somanath | F01D 5/148 416/233 |
| 2008/0260538 | A1 * | 10/2008 | Wilson | F01D 5/147 416/97 R |
| 2010/0247329 | A1 * | 9/2010 | Morgan | F01D 5/147 416/97 R |
| 2011/0305580 | A1 | 12/2011 | Wilson, Jr. et al. | |
| 2012/0237351 | A1 | 9/2012 | Weisse | |
| 2014/0234088 | A1 | 8/2014 | Brandl | |

OTHER PUBLICATIONS

U.S. Appl. No. 15/352,020, filed with the U.S. Patent and Trademark Office, Alexandria, VA on Nov. 15, 2016, pp. 1-33, "Airfoil Leading Edge Impingement Cooling."

U.S. Appl. No. 15/214,799, filed Jul. 20, 2016, pp. 1-36, entitled "Turbine Airfoils With Micro Cooling Features," filed with the U.S. Patent and Trademark Office, Alexandria, VA.

* cited by examiner

UNDERCUT ON AIRFOIL COVERSHEET SUPPORT MEMBER

TECHNICAL FIELD

This disclosure relates to airfoils and, in particular, to support members for coversheets on airfoils.

BACKGROUND

Present approaches to providing structural support to coversheets suffer from a variety of drawbacks, limitations, and disadvantages. For example, the interface between the coversheet and the spar may experience various stresses that may compromise the structural integrity of the airfoil. There is a need for inventive support structures, apparatuses, systems and methods disclosed herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Airfoils with coversheets applied to spars are exposed to numerous stresses, particularly when the airfoil is located in a hot section of a turbine engine. Subjecting the bond between a coversheet of an airfoil and a spar of the airfoil to these stresses may result in structural damage to the airfoil. Methods of providing an undercut on a support member for a coversheet and coversheet support systems having undercuts are provided. By way of introductory example, a coversheet support system may include a spar. The spar may include a support member on an outer surface of the spar. The support member may extend outward from the outer surface of the spar. The support member may include an outer surface and an undercut. The undercut may be located in a portion of the support member between the outer surface of the spar and the outer surface of the support member. In addition, the coversheet support system may include a coversheet. The coversheet may be metallurgically bonded to the outer surface of the support member.

One interesting feature of the systems and methods described below may be that the undercut of the support member may reduce or dampen stress, such as sheering stress, on the coversheet bonded to the support member. Alternatively, or in addition, an interesting feature of the systems and methods described below may be that the cooling paths defined by the support member with the undercut may reduce thermal stresses on the coversheet and regions neighboring the coversheet, such as the support member and spar.

Figure 1:
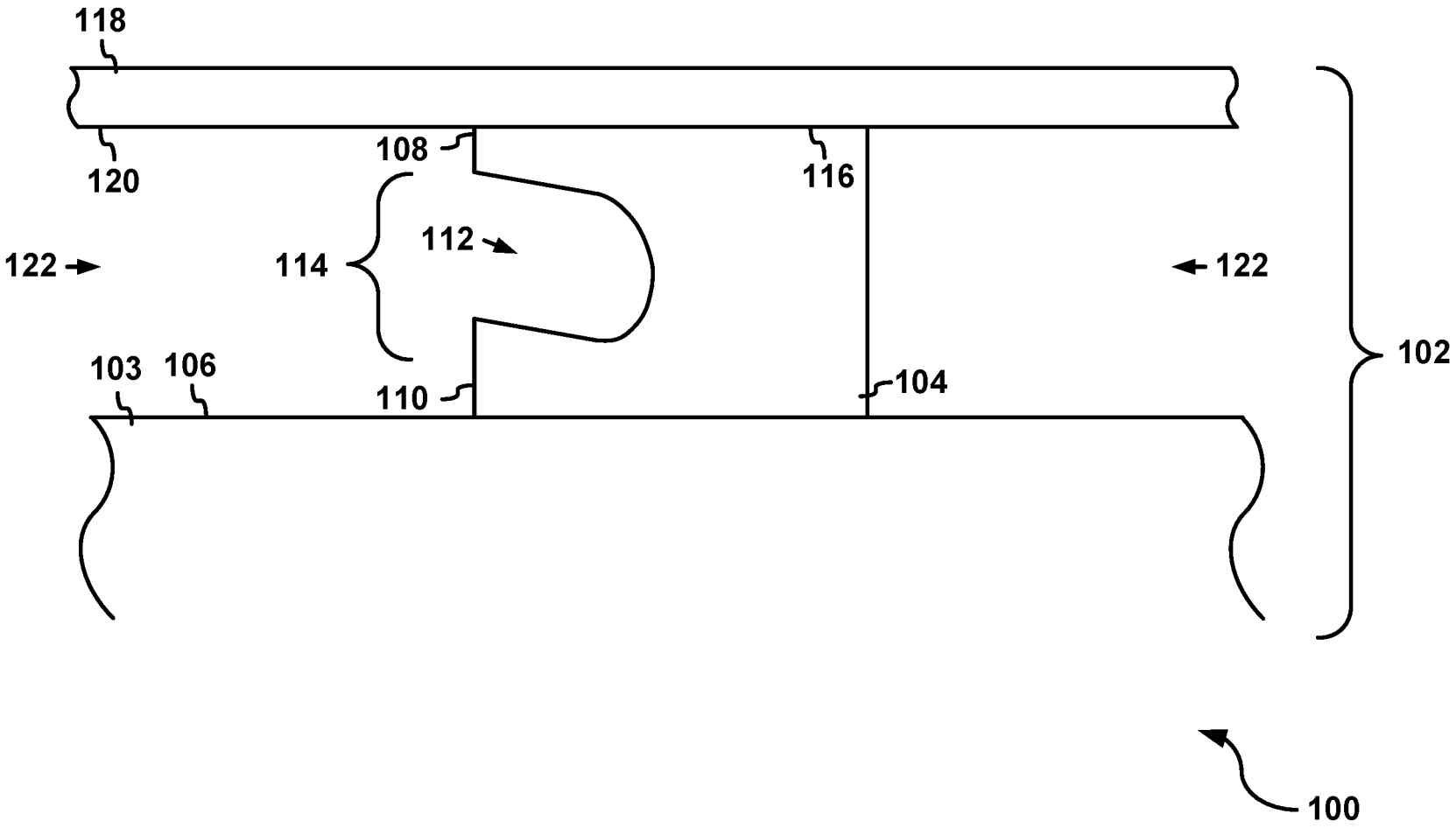
FIG. 1 illustrates an example of a coversheet support system.

FIG. 1 illustrates an example of a coversheet support system 100. The coversheet support system 100 may include an airfoil 102 (only a portion of the airfoil 102 is shown in FIG. 1). The airfoil 102 may include a spar 103. The spar 103 may include a support member 104 on an outer surface 106 of the spar 103. The support member 104 may extend outward from the outer surface 106 of the spar 103. The support member 104 may include a first protrusion 108 and a second protrusion 110. The second protrusion 110 may extend along an outer surface 106 of the spar 103. The first protrusion 108 may be positioned on the support member 104 further from the outer surface 106 of the spar 103 than the second protrusion 110.

The support member 104 may include an undercut 112. The first protrusion 108 may define the undercut 112 in the support member 104 between the outer surface 116 of the support member 104 and the outer surface 106 of the spar 103. In some examples, the support member 104 may only include the first protrusion 108. Alternatively, as illustrated in FIG. 1, the support member 104 may include the second protrusion 110 to further define the undercut 112. Thus, for example, the undercut 112 may be defined between the first protrusion 108 and the second protrusion 110. In other examples, additional protrusions may further define the undercut 112.

The coversheet support system 100 may include a coversheet 118 in some examples. The support member 104 may receive the coversheet 118. An inner surface 120 of the coversheet 118 may be metallurgical bonded to the outer surface 116 of the support member 104. A cooling path 122 may be completely or partially defined by at least one of the outer surface 106 of the spar 103, the support member 104, and the inner surface 120 of the coversheet 118.

The coversheet support system 100 may provide support for the coversheet 118 of the airfoil 102. In some examples, rotating structures, such as a turbine rotor, may include the coversheet support system 100. Alternatively or in addition, static structures, such as a nozzle, may include the coversheet support system 100. The airfoil 102 of the coversheet support system 100 may include a blade, a vane, or any other static or rotating component configured to guide air or drive a shaft.

The spar 103 may be a structural member of the airfoil 102 that provides mechanical support to the airfoil 102. The spar 103 may define the general shape and contours of the airfoil 102. The spar 103 may be a unitary structure or a combination of individual members. For example, the spar 103 may include a series of cross sections of a predefined width joined together. In other examples, the spar 103 may include a combination of sections. The material of the spar 103 may include metal, metal alloy, and/or any other type of suitable material. The spar 103 may include features, such as the support member 104, on the surface 106 of the spar 103. Alternatively or in addition, the spar 103 may include cooling features, such as a cooling hole (not shown) configured to direct cooling fluid onto the surface 106 of the spar 103 and/or onto the inner surface 120 of the coversheet 118.

The support member 104 may be a raised portion of the spar 103 that extends away from the outer surface 106 of the spar 103. The support member 104 may support or be configured to support the coversheet 118. Alternatively or in addition, the support member 104 may partially or completely define the cooling path 122. The location, size, and/or shape of the support member 104 may vary along the outer surface 106 of the spar 103. In addition, the support member 104 may be arranged with other support members in a uniform and/or a non-uniform arrangement on the outer surface 106 of the spar 103. The support member 104 may be constructed of metal, metal alloy, and/or any other type of suitable material. The support member 104 may include the same materials as the spar 103. Alternatively or in addition, the support member 104 may include different materials than the spar 103. The support member 104 may be integral with the spar 103 or be coupled to the spar 103.

The support member 104 may be a unitary structure or a combination of individual members joined together. For example, the support member 104 may include the first protrusion 108 and the second protrusion 110. The first protrusion 108 and/or the second protrusion 110 may represent all of, or a portion of, the support member 104. Alternatively or in addition, the first protrusion 108 and/or the second protrusion 110 may be structures that join to form the support member 104. Only the one support member 104 is shown in FIG. 1. The spar 103 may include multiple support members arranged to form a cooling pattern.

The first protrusion 108 and/or the second protrusion 110 may partially or completely define the undercut 112. For example, the first protrusion 108 may define the undercut 112 in a portion 114 of the support member between the outer surface 106 of the spar and the outer surface 116 of the support member 104. The first protrusion 108 may be positioned further from the outer surface 106 of the spar 103 than the second protrusion 110. The first protrusion 108 may extend in any parallel or non-parallel direction to the surface 116 of the support member 104 and/or the surface 106 of the spar 103. Alternatively or in addition, the first protrusion 108 may extend along the inner surface 120 of the coversheet 118. In some examples, the first protrusion 108 may abut the inner surface 120 of the coversheet 118.

The first protrusion 108 and the outer surface 106 of the spar 103 may define the undercut 112 on the support member. In other examples, such as the example illustrated in FIG. 1, the second protrusion 110 may further define the undercut 112. For example, the first protrusion 108 and the second protrusion 110 may define the undercut 112 in the portion 114 of the support member 104 between the outer surface 106 of the spar 103 and the outer surface 116 of the support member 104. The second protrusion 110 may extend in any parallel or non-parallel direction to the surface 106 of the spar 104 or the surface 116 of the support member 104. For example, the second protrusion 110 may extend along the outer surface 106 of the spar 103. In some examples, the second protrusion 110 may abut the outer surface 106 of the spar 103. In other examples not illustrated in FIG. 1, additional or fewer protrusions may partially or completely define the undercut 112.

The undercut 112 may be a recess in the support member 104. The undercut 112 may be positioned on the support member 104 in the portion 114 of the support member 104 between the outer surface 106 of the spar 103 and the outer surface 116 of the support member 104. Alternatively or in addition, the undercut 112 may be positioned on the support member 104 between the outer surface 106 of the spar 103 and the inner surface 120 of the coversheet 118. The size and shape of the undercut 112 may vary. For example, a cross section of the undercut 112 may include a curved portion, as illustrated in the example in FIG. 1. In other examples, the cross section of the undercut 112 may include a wedge, a half-rectangle, or any other suitable cross section. The undercut 112 may extend into any portion of the support member 104 and at any depth. In addition, the undercut 112 may extend into the support member 104 in any direction. For example, the undercut 112 may extend in toward the outer surface 106 of the spar 103, as illustrated in FIG. 1. In other examples, the undercut 112 may extend toward the coversheet 118, or in any other direction.

The coversheet support system 100 may include the cooling path 122. The cooling path 122 may be a path to direct cooling fluid. The support member 104 may partially or completely define the cooling path 122. Alternatively or in addition, the undercut 112 may partially or completely define the cooling path 122. For example, as illustrated in FIG. 1, the first protrusion 108 and the second protrusion 110 may partially form the cooling path 122. Alternatively or in addition, the outer surface 106 of the spar 103 and/or the inner surface 120 of the coversheet 118 may partially or completely form the cooling path 122. In other examples, additional features on the airfoil 102 or neighboring regions may define the cooling path 122.

The coversheet 118 may be a wall or sheet on the outermost portion of the airfoil 102. The coversheet 118 may be a unitary sheet or a combination of sheets joined together. The coversheet 118 may be coupled to, and/or mounted on the outer surface 106 of the spar 103. Alternatively or in addition, the support member 104 may receive the coversheet 118. For example, the outer surface 116 of the support member 104 may receive the inner surface 120 of the coversheet 118. The coversheet 118 may join to the outer surface 116 of the support member 104 by any manufacturing technique known in the art. For example, a bonding process may bond the coversheet 118 to the support member 104. The bonding process may be a metallurgical bonding process or any other bonding process known in the art. The bonding process may include brazing, linear precision welding, diffusion bonding, inertia welding or any other bonding process.

Figure 2:
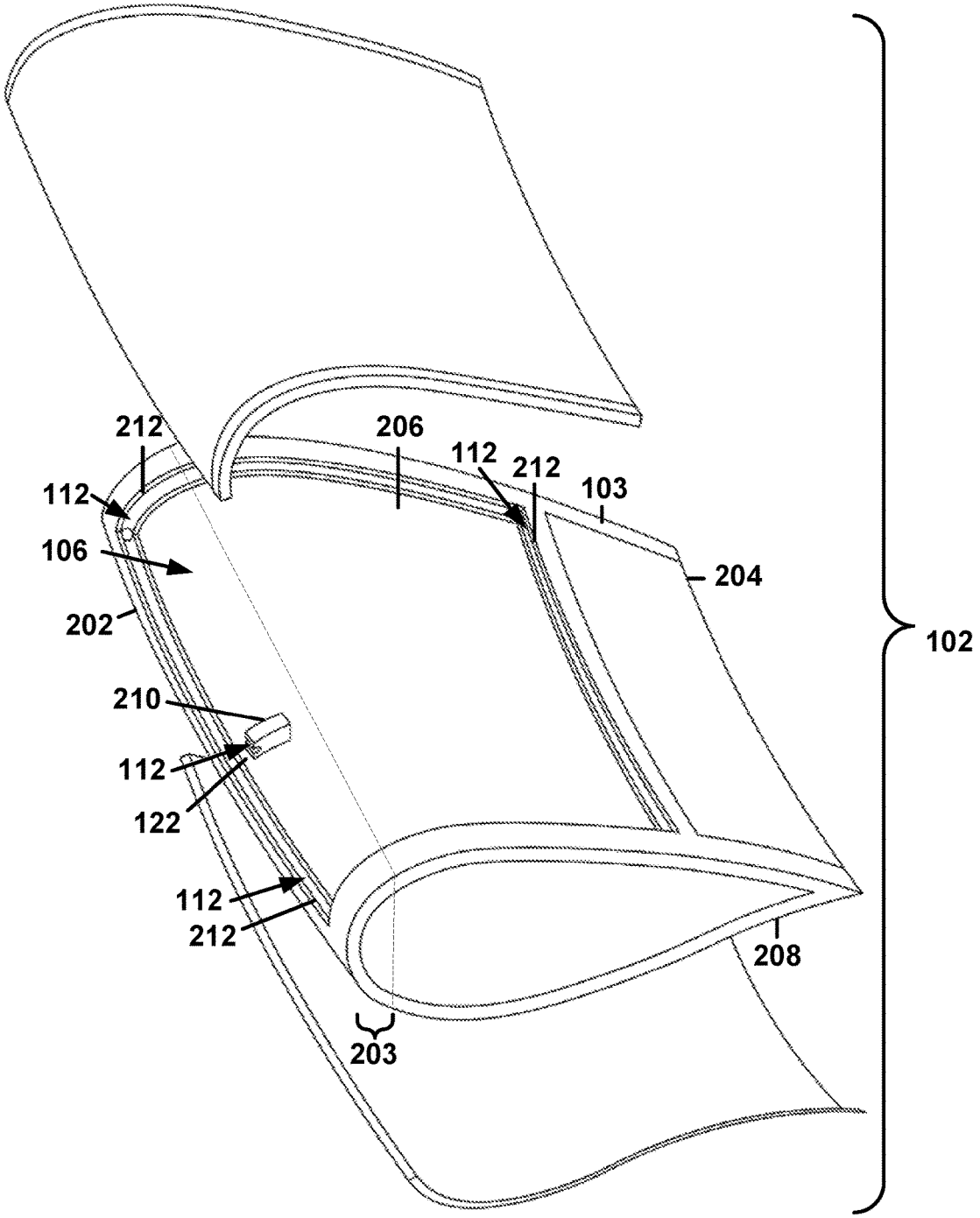
FIG. 2 illustrates examples of a support member.

Stresses on the airfoil 102 may vary across portions of the airfoil 102, which may be addressed by providing corresponding configurations of the support member 104 and/or the cooling path 122. The shape, size, and/or other attributes of the support member 104 may vary depending, for example, on the positioning of the support member 104 on the spar 103. Alternatively or in addition, the shape, size, flow path, and other attributes of the cooling path 122 may vary along the outer surface 106 of the spar 103. The spar 103 may include any arrangement, both uniform and non-uniform, of support members and cooling paths FIG. 2 illustrates an example of the support member 104 on the airfoil 102. The spar 103 may include a leading edge 202, a leading edge region 203, a trailing edge 204, a suction side 206, and a pressure side 208. Various examples of the support member 104 and or the cooling path 122 may be positioned on one or more of the leading edge 202, the leading edge region 203, the trailing edge 204, the suction side 206 and the pressure side 208 of the airfoil 102. Examples of the support member 104 may include a rib 210, a dam 212, and/or other configurations.

The leading edge 202 may be an edge of the spar 103 where the suction side 206 and the pressure side 208 join. The leading edge may face upstream of a fluid flow that flows over the airfoil 102. In many examples, such as the example illustrated in FIG. 2, the leading edge 202 may be an arcuate portion of the spar 103 located toward the wider end of the cross section of the spar 103.

The leading edge region 203 may be a portion of the spar 103 located at the leading edge 202 of the spar. For example, the leading edge region 203 may be 25%, or less, of the span of the spar 103, the leading edge region 203 beginning at the leading edge 202 of the spar 103 and extend toward the trailing edge 204 of the spar 103. The leading edge region 203 may extend toward the trailing edge 204 from the leading edge 202 on both the suction side 206 and pressure side 208 of the spar 103.

The rib 210 may include an elongated support member that has an undercut 112 at an end of the elongated support member. Any portion of the spar 103 may include the rib 210. In the example illustrated in FIG. 2, the rib 210 may extend across the outer surface 106 of the spar 103 on the suction side 206 of the spar 103. In other examples, the spar 103 may include the rib 210 along the leading edge 202, the leading edge region 203, trailing edge 204, suction side 206 and/or pressure side 208 of the spar 103.. In addition, the rib 210 may extend across the outer surface 106 of the spar 103 in any direction. The spar 103 may include the rib 210 with other ribs in any arrangement, both uniform and non-uniform. The undercut 112 may be defined on any portion of the rib 210. For example, the undercut 112 may be defined at an end of the rib 210, as illustrated in FIG. 2. Alternatively or in addition, the rib 210 may include the undercut 112 along a length of the rib 210.

The spar 103 may include the rib 210 at, or in the vicinity of, the leading edge region 203 of the spar 103. As illustrated in the example in FIG. 2, the spar 103 may include the rib 210 on the suction side 206 of the spar 103 with the undercut 112 of the rib 210 facing the leading edge 202 of the spar 103. The protrusions 108, 110 on the rib 210 may define the undercut 112 of the rib on the leading edge 202 of the spar 103. Alternatively or in addition, the protrusions 108, 110 of the rib 210 may define the undercut 112 of the rib 210 to face any direction on the leading edge region 203 of the spar 103. In other examples, the protrusions 108, 110 may define the undercut 112 to face any direction on, or in the vicinity of, the leading edge 202 of the spar 103, or any other portion of the spar 103.

The dam 212 may an example of the support member 104 with the undercut 112 extending along the length of the support member 104. The dam 212 may define the cooling path 122 on the outer surface 106 of the spar 103 to direct flow of the cooling fluid in any direction across the outer surface 106 of the spar 103 and/or neighboring regions. In some examples, the dam 212 may direct cooling fluid to and/or from cooling paths partially or completely defined by other support members, such as the rib 210. In some examples, the dam 212 may extend across the leading edge 202 of the spar 103. Alternatively or in addition, the dam 212 may extend along the perimeter of the suction side 206 of the spar 103. In other examples not shown in FIG. 1, the dam 212 may be positioned on the leading edge region 203, the pressure side 208, the trailing edge 204, and/or any other section of the spar 103. The dam 212 may be arranged with other examples of the support member 104 to partially or completely define the cooling path 122.

The rib 210 and the dam 212 illustrated in FIG. 2 are non-limiting examples of the support member 104. Additional or alternative examples may exist. For example, the cross-sectional shape of the support member 104 may include a square, a rectangle, a triangle, a circle, any other geometric or non-geometric shape, and/or any combinations thereof. The spar 103 may include any arrangement, both uniform and non-uniform, of the rib 210, the dam 212, and/or any addition examples of the support member 104. The rib 210, the dam 212, and/or any additional examples of the support member 104 may include the first protrusion 108, the second protrusion 110, and/or additional protrusions to define the undercut 112. The undercut 112 may be defined on the support member 104 positioned anywhere on the surface 106 of the spar 103. Furthermore, the undercut 112 may open in any direction on the support member 104.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

Furthermore, the advantages described above are not necessarily the only advantages, and it is not necessarily expected that all of the described advantages will be achieved with every embodiment.

The subject-matter of the disclosure may also relate, among others, to the following aspects.

A first aspect includes an airfoil for a gas turbine engine, the airfoil comprising a spar comprising a support member on an outer surface of the spar, the support member extending outward from the outer surface of the spar, the support member comprising an outer surface and an undercut, wherein the undercut is located in a portion of the support member between the outer surface of the spar and the outer surface of the support member; and a coversheet, wherein an inner surface of the coversheet is metallurgically bonded to the outer surface of the support member.

A second aspect includes the airfoil of the first aspect, wherein the support member comprises a dam.

A third aspect includes the airfoil of any of the first through the second aspects, wherein the support member comprises a rib.

A fourth aspect includes the airfoil of any of the first through the third aspects, wherein the support member is positioned along a leading edge of the spar.

A fifth aspect includes the airfoil of any of aspects the first through the fourth aspects, wherein the support member is positioned on a leading edge region of the spar.

A sixth aspect includes the airfoil of any of the first through the fifth aspects, wherein the undercut faces a leading edge of the spar.

A seventh aspect includes the airfoil of any of the first through the sixth, wherein the support member is positioned on a suction side of the spar.

An eighth aspect includes a spar for an airfoil of a gas turbine engine, the spar comprising: a support member configured to support a coversheet, the support member positioned on an outer surface of the spar, wherein the support member comprises a protrusion that defines an undercut in the support member between the protrusion and the outer surface of the spar, wherein the outer surface of the support member is configured to receive the coversheet.

A ninth aspect includes the spar of the eighth aspect, wherein the protrusion is a first protrusion and the support member further comprises a second protrusion, wherein the undercut is defined by the first protrusion and the second protrusion.

A tenth aspect includes the spar of any of the eighth through the ninth aspects, further comprising a coversheet, wherein the support member is metallurgically bonded to the coversheet.

An eleventh aspect includes the spar of any of the eighth through the tenth aspects, wherein the protrusion defines the undercut at a leading edge region of the spar.

A twelfth aspect includes the spar of any of the eighth through the eleventh aspects, wherein the spar comprises a plurality of support members arranged in a cooling pattern, at least two of the support members having undercuts.

A thirteenth aspect includes the spar of any of the eighth through the twelfth aspects, wherein the support member at least in part defines a cooling path on the outer surface of the spar.

A fourteenth aspect includes the spar of any of the eighth through the thirteenth aspects, wherein the cooling path is partially defined by the protrusion.

A fifteenth aspect includes an airfoil for a gas turbine engine, the airfoil comprising: a spar comprising a support member on an outer surface of the spar, wherein the support member is configured to receive a coversheet on an outer surface of the support member, wherein the support member comprises a protrusion that defines an undercut on the support member, wherein the undercut is defined between the protrusion and the outer surface of the spar.

A sixteenth aspect includes the airfoil of the fifteenth aspect, wherein the coversheet is metalurgically bonded to the support member.

A seventeenth aspect includes the airfoil of any of the fifteenth through the sixteenth aspects, wherein protrusion is a first protrusion and the support member further comprises a second protrusion positioned between the first protrusion and the outer surface of the spar, where in the first protrusion and the second protrusion define the undercut.

An eighteenth aspect includes the airfoil of any of the fifteenth through the seventeenth aspects, further comprising a coversheet, wherein an inner surface of the coversheet is bonded to the outer surface of the support member.

A nineteenth aspect includes the airfoil of any of the fifteenth through the eighteenth aspects, wherein the coversheet is bonded to the support member on a leading edge region of the spar.

A twentieth aspect includes the airfoil of any of the fifteenth through the nineteenth aspects, wherein the support member is configured to direct cooling fluid between the outer surface of the spar and the coversheet.

What is claimed is:

1. An airfoil for a gas turbine engine, the airfoil comprising:

a spar comprising a support member on an outer surface of the spar, the support member elongated with respect to a first end and a second end of the support member, the support member raised from the outer surface of the spar and extending along the outer surface of the spar away from a leading edge of the spar and toward a trailing edge of the spar, the first end of the support member positioned on the leading edge of the spar where a suction side and a pressure side of the spar meet, the first end of the support member comprising an undercut, wherein the undercut is located in a portion of the first end of the support member between an outer surface of the spar and an outer surface of the support member; and a coversheet, wherein an inner surface of the coversheet is metallurgically bonded to the outer surface of the support member.

2. The airfoil of claim 1, wherein the support member comprises a dam.

3. The airfoil of claim 1, wherein the support member comprises a rib.

4. The airfoil of claim 1, wherein the undercut faces the leading edge of the spar.

5. The airfoil of claim 1, wherein the support member is positioned on the suction side of the spar.

6. A spar for an airfoil of a gas turbine engine, the spar comprising: an elongated support member, the elongated support member raised from an outer surface of the spar, the elongated support member extending along the outer surface of the spar away from a leading edge of the spar and toward a trailing edge of the spar, an end of the elongated support member positioned along a leading edge of the spar where a suction side and a pressure side of the spar meet, wherein the end of the elongated support member comprises a protrusion that defines an undercut in the elongated support member between the protrusion and the outer surface of the spar, wherein an outer surface of the an elongated support member is configured to receive a coversheet of the airfoil.

7. The spar of claim 6, wherein the protrusion is a first protrusion and the elongated support member further comprises a second protrusion, wherein the undercut is defined by the first protrusion and the second protrusion.

8. The spar of claim 6, wherein the protrusion defines the undercut at a leading edge region of the spar.

9. The spar of claim 6, wherein the spar comprises a plurality of support members arranged in a cooling pattern, at least two of the support members having undercuts.

10. The spar of claim 6, wherein the elongated support member at least in part defines a cooling path on the outer surface of the spar.

11. The spar of claim 10, wherein the cooling path is partially defined by the protrusion.

12. An airfoil for a gas turbine engine, the airfoil comprising; a spar comprising an elongated support member on an outer surface of the spar, the elongated supported member extending along the outer surface of the spar away from a leading edge of the spar and toward a trailing edge of the spar, an end of the elongated support member positioned along the leading edge of the spar where a suction side and a pressure side of the spar meet, wherein the elongated support member comprises a protrusion that defines an undercut on the elongated support member, wherein the undercut is defined between the protrusion and the outer surface of the spar; and a coversheet, wherein an inner surface of the coversheet is positioned on an outer surface of the elongated support member.

13. The airfoil of claim 12, wherein the coversheet is metalurgically bonded to the elongated support member.

14. The airfoil of claim 12, wherein the protrusion is a first protrusion and the elongated support member further comprises a second protrusion positioned between the first protrusion and the outer surface of the spar, wherein the first protrusion and the second protrusion define the undercut.

15. The airfoil of claim 12, wherein the inner surface of the coversheet is bonded to the outer surface of the elongated support member.

16. The airfoil of claim 15, wherein the coversheet is bonded to the elongated support member on a leading edge region of the spar.

17. The airfoil of claim 15, wherein the elongated support member is configured to direct cooling fluid between the outer surface of the spar and the coversheet.

* * * * *